United States Patent [19]

Kubach

[11] 4,390,857

[45] Jun. 28, 1983

[54] ELECTROMAGNET

[75] Inventor: Hans Kubach, Korntal-Münchingen, Fed. Rep. of Germany

[73] Assignee: Robert Bosch GmbH, Stuttgart, Fed. Rep. of Germany

[21] Appl. No.: 326,090

[22] Filed: Nov. 30, 1981

[30] Foreign Application Priority Data

Dec. 12, 1980 [DE] Fed. Rep. of Germany ..... 3046891

[51] Int. Cl.[3] ..... H01F 7/08

[52] U.S. Cl. ..... 335/282; 335/281

[58] Field of Search ..... 335/220, 131, 251, 255, 335/281, 282

[56] References Cited

U.S. PATENT DOCUMENTS 3,472,141 10/1969 Hilbig et al. ..... 335/281 X 3,745,496 7/1973 Ticky ..... 335/281 X

*Primary Examiner*—George Harris

*Attorney, Agent, or Firm*—Edwin E. Greigg

[57] ABSTRACT

An electromagnet is proposed which is intended in particular for controlling a fuel injection valve for internal combustion engines. The electromagnetic includes a flat armature and a magnetic winding applied to a shell core of ferromagnetic material. In order to minimize the spatial dimensions of the magnetic circuit and to improve the rapidity of operation of the electromagnet, the quotient $A/l_m$, where A is the window surface area of the shell core and $l_m$ is the average winding length of the magnetic coil, is selected to be as small as possible. Furthermore, the magnetic circuit is embodied such that at the onset of the attracting movement of the flat armature, a magnetic induction B which is approximately 70% of the saturation induction prevails in the vicinity of the two axially acting air gaps, which have magnetic surface areas, $A_1$, $A_2$ of approximately equal size.

6 Claims, 2 Drawing Figures

ELECTROMAGNET

BACKGROUND OF THE INVENTION

The invention is based on an electromagnet for controlling a fuel injection valve in an internal combustion engine. This electromagnet includes a ferromagnetic shell core, an armature and a magnetic winding. A known electromagnet, however, has the disadvantage of being very large in dimension and requiring a great amount of space; furthermore, it does not operate rapidly enough.

OBJECT AND SUMMARY OF THE INVENTION

The electromagnet according to the invention has dimensions selected according to a formula discussed below and has the advantage over the prior art that the magnetic circuit and the magnetic winding are minimized in size, so that the electrical triggering power and the armature mass can be minimized as well. The ratio of the window surface area of the shell core to the winding length is selected to be as small as possible. The result is an electromagnet which occupies a very small volume and operates very rapidly, and in which the conversion of electrical energy into mechanical energy is as efficient as possible.

As a result of the characteristics disclosed herein, advantageous further embodiments of and improvements to the electromagnet described are possible.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
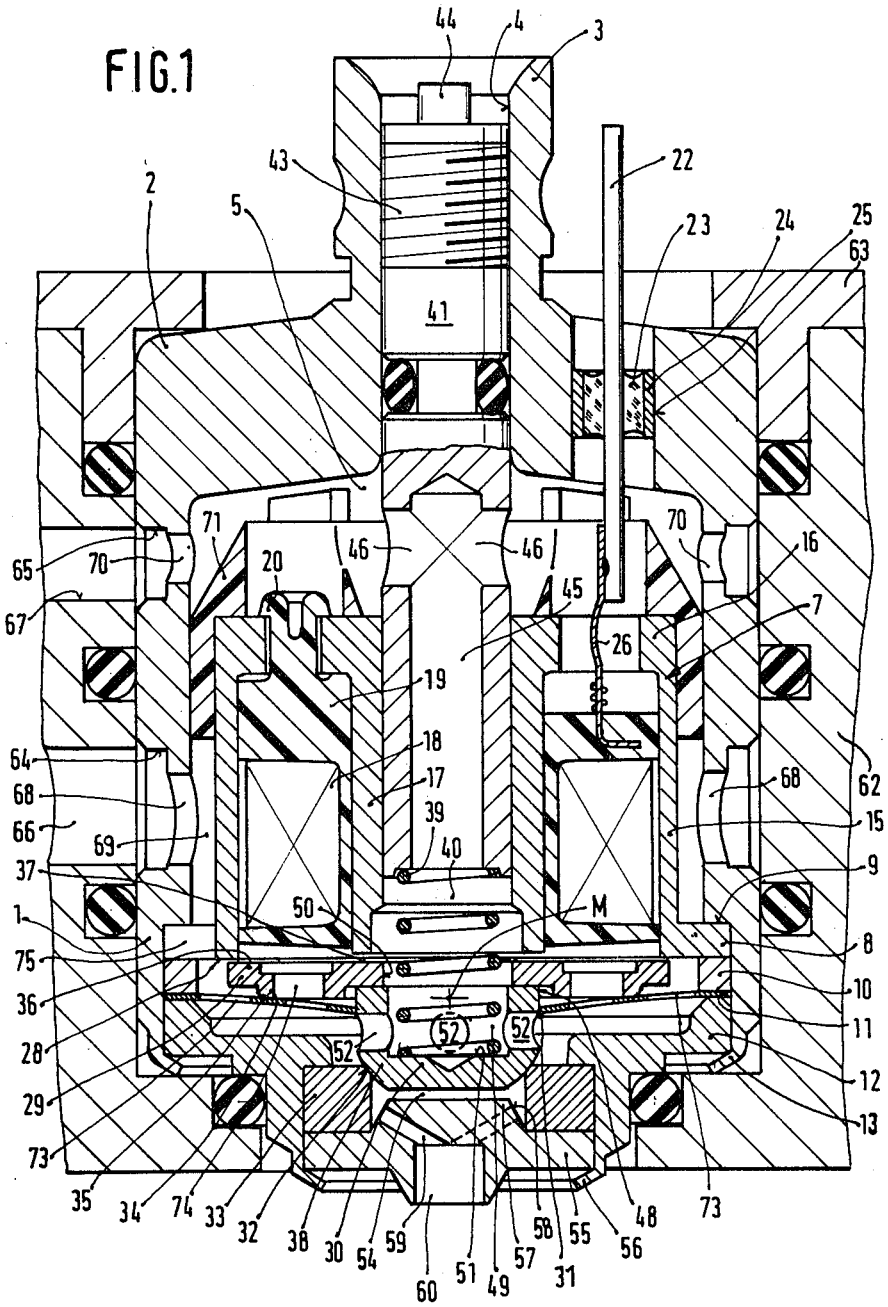
FIG. 1, in simplified form, shows a fuel injection valve having an electromagnet embodied in accordance with the invention.

The fuel injection valve shown in FIG. 1, which is intended for a fuel injection system, serves by way of example to inject fuel, in particular at low pressure, into the intake tube of mixture-compressing internal combustion engines with externally supplied ignition. A valve housing 1 is fabricated by a non-cutting shaping method, such as deep drawing, rolling and the like; it has a cup-shaped form with a bottom 2, from which a tubular guide fitting 3 protrudes. The guide fitting 3 has a guide bore 4, which likewise passes through the base 2 and discharges in the interior of the valve housing 1. A shell core 7 of ferromagnetic material is inserted into the interior 5 of the valve housing 1. The shell core 7 has a smaller diameter than does the interior 5 and rests with a shoulder 8 on an inner step 9 of the valve housing 1. A spacer ring 10 engages the side of the shoulder 8 remote from the inner step 9. The spacer ring 10 is adjoined in sequence by a guide diaphragm 11 and then a nozzle carrier 12, with a crimped edge 13 engaging the end face of the nozzle carrier 12 by partially surrounding it and exerting an axial stress on the nozzle carrier. This axial stress assures the positional fixation of the shell core 7, the spacer ring 10, the guide diaphragm 11 and the nozzle carrier 12. A conventional shell-type core of type T 26 made by Siemens may be used as the shell core 7; this has an annular outer core 15 and an annular inner core 17 connected to the outer core via a crosspiece 16. A magnetic winding 18 is surrounded at least partially by an insulating carrier body 19, which is inserted together with the magnetic coil 18 into the annular chamber of the shell core 7 formed between the outer core 15 and the inner core 17 and is connected in a positively engaged manner with the crosspiece 16, for instance by means of rivets 20 or by a releasable snap-lock connection. The supply of electric current to the magnetic coil 18 is advantageously effected via contact pins 22, only one of which is shown, which are embedded in an insulating insert 23 of glass, for example. The insulating insert 23 may be surrounded by a fastening ring 24 which is sealingly inserted into an open bore 25 of the valve housing bottom 2 and fixed in place by soldering, for example. Either plug connections or electric cables may be connected with the contact pins 22 in a manner which is known but not illustrated here. In order to compensate for changes in length in the case of heat expansion, a contact lug 26 is provided between the magnetic coil 18 and each of the contact pins 22.

A flat armature 29 is disposed between the end face 28 of the shell core 7 which is remote from the crosspiece 16 and the guide diaphragm 11. In the middle portion of the flat armature 19, a movable valve element 30 is connected with the flat armature, by welding or soldering, for instance. The valve element 30 passes through a central guide opening 31 in the guide diaphragm 11 and cooperates with a fixed valve seat 32 embodied in a valve seat body 33. The valve seat body 33 is inserted into the nozzle carrier 12. The valve element 30 and the flat armature 29 are carried through the central guide opening 31 of the guide diaphragm 11 in the radial direction both to the valve seat 32 and to the end face 28 of the shell core 7. A rigid connection of the guide diaphragm 11 is not provided, either with the valve element 30 or with the flat armature 29. The flat armature 29 may be embodied as a stamped or pressed part and may have, by way of example, an annular guide crown 34 oriented toward the guide diaphragm 11. This guide crown 34, first, improves the rigidity of the flat armature 29; secondly, it separates a first work area 36 of the flat armature, which is oriented toward the end face of the outer core 15, from a second work area 37, which is oriented toward the end face of the inner core 17; and thirdly, it forms a guide edge 35 which rests on the guide diaphragm 11, as a result of which the flat armature 29 is guided in a parallel plane to the end face 28 of the shell core 7. The valve element 30 has a spherical portion 28 cooperating with the valve seat 32, which may be flattened out in the form of a spherical zone. The clamping of the guide diaphragm 11 between the spacer ring 10 and the nozzle carrier 12 is effected in a plane which, when the valve element 30 rests on the valve seat 32, extends through the center point M or as close as possible to the center point M of the spherical portion 38. When the valve element 30 is resting on the valve seat 32, the guide diaphragm 11 rests under stress, fully drawn up, on the guide edge 35 of the flat armature 29. The valve element 30 is urged in the closing direction of the valve by a compression spring 39, which on the other end protrudes into an inner bore 40 of the shell core 7 and is supported on a slide member 41. The force of the compression spring 39 upon the flat armature 29 and the valve element 30 may be influenced by means of axially displacing the slide member 41.

The slide member 41 is pressed at its end remote from the flat armature into the guide bore 4 of the bottom 2 and the guide fitting 3. In the area of the guide fitting 3, the slide member 41 has a portion having notches 43, such as flat annular grooves, threads, knurls or the like, in order to assure a better axial fixation of the slide member 41. The guide fitting 3 is pressed inward in the area of the notches 43 such that part of the material comprising the guide fitting 3 presses into the notches 43 of the slide member 41. The end of the slide member 41 remote from the flat armature 29 is embodied such that it terminates inside the guide fitting 3 and has a tang 44 having a smaller diameter than that of the guide bore 4. A suitable tool may engage the tang 44 in order to effect the displacement of the slide member 41. The slide member 41 has a longitudinal bore 45 open toward the flat armature 29; this bore 45 discharges on the other end outside the shell core 7, via transverse bores 46 leading to the circumference of the slide member 41, into the interior 5 of the valve housing 1.

The valve element 30 has a cylindrical portion 48 connected with the flat armature 29, which is adjoined by the spherical portion 38 of the valve element. The valve element 30 is open in the direction of the flat armature 29, being provided with a concentric blind bore 49, which leads as far as possible into the spherical portion 38. The compression spring 39, which at one end rests on the slide member 41, passes through an opening 50 of the flat armature and is supported at the other end in the valve element 30 on the bottom 51 of the blind bore 49. As a result, when the magnetic element 7, 18, 29 is not excited, the valve element is held in a sealing manner on the valve seat 32, counter to the spring force of the guide diaphragm 11. Transverse bores 52 extend from the circumference of the valve element 30 to the blind bore 49.

A collector chamber 54 is embodied downstream of the valve seat 32; its volume is intended to be as small as possible, and it is defined by the valve seat body 33, the spherical portion 38 and a swirl body 55 disposed downstream of the valve seat body 33. A crimped area 56 of the nozzle body 12 surrounds and engages a surface of the swirl body 55 which is remote from the valve seat body 33; as a result, the valve seat body 33 and the swirl body 55 are positionally fixed. The swirl body 55 has a protrusion 57 protruding into the collector chamber 54, its end face being flattened toward the valve element 30. Branching off from the lateral circumferential wall 58, which extends conically by way of example, of the protrusion 57 are swirl conduits 59 open in the direction of the collector chamber 54. In a known manner, these swirl conduits 59 may be inclined at an angle relative to the valve axis and discharge into a swirl chamber 60. The swirl conduits 59 may discharge, by way of example, at a tangent into the swirl chamber 60 and serve to meter the fuel. The fuel film forming at the wall of the swirl chamber 60 tears off at the sharp end of the swirl chamber 60 which discharges into the intake tube; the fuel thus enters the air flow of the intake tube in a conical pattern, which assures good preparation of the fuel, especially in the case of low fuel pressures.

The fuel injection valve supported in a holder body 62 may be positionally fixed, by way of example, by a claw or a cap 63, and in the valve housing 1 it has a first annular groove 64 and a second annular groove 65; the second annular groove 65 is offset in the axial direction and sealed off from the first annular groove 64. A fuel inflow line 66 is embodied in the holder body 62, discharging into the first annular groove 64. A fuel return flow line 67 is also embodied in the holder body 62, communicating with the second annular groove 65. Radial inflow openings 68 in the wall of the cylindrical, tubular portion of the valve housing 1 connect the first annular groove 64 with a flow conduit 69, which is embodied between the outer core 15 and the inner wall of the valve housing 1. The portion of the interior 5 located above the shell core 7 communicates with the second annular groove 65 via radially extending outflow openings 70 embodied in the cylindrical, tubular portion of the valve housing 1 and is separated from the flow conduit 69 by means of a sealing body 71. The guide diaphragm 11 has flowthrough openings 73, and flowthrough openings 74 may also be embodied within the flat armature 29. The fuel flowing into the flow conduit 69 via the inflow openings 68 is capable of flowing to the valve seat 32 via openings 75 in the shoulder 8 and the flowthrough openings 73 in the guide diaphragm 11; from the valve seat 32, when the valve element 30 is raised from the valve seat 32, the fuel can reach the collector chamber 54 and is there metered via the swirl conduits 59. The nonmetered portion of the fuel can flow via the transverse bores 52 into the blind bore 49 of the valve element 30 and from there, via the inner bore 40 or the longitudinal bore 45 of the slide member 41 and the transverse bores 46, into the portion of the interior 5 located above the shell core 7, meanwhile absorbing the heat being created in the magnetic circuit. From there, the fuel can flow via the outflow openings 70 and the second annular groove 65 into the fuel return flow line 67.

Figure 2:
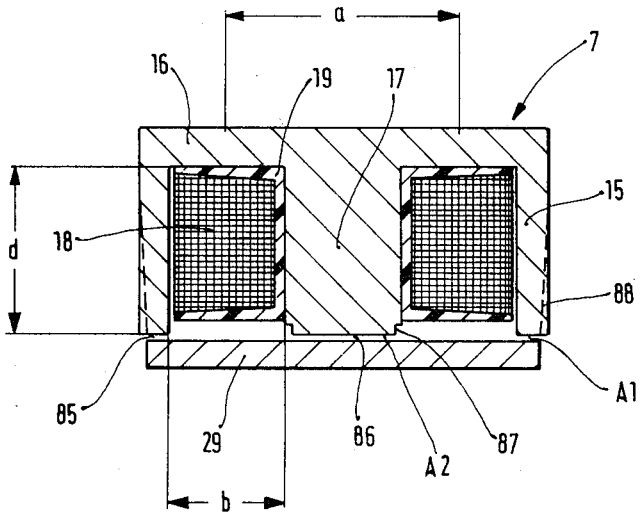
FIG. 2 shows the fundamental features of an electromagnet embodied in accordance with the invention.

For the sake of clarity, the magnetic circuit 7, 18, 29 used in the fuel injection valve of FIG. 1 is again shown in simplified form in FIG. 2. The critical factor in the dimensioning of the magnetic circuit is the maximum current intensity, which is provided by an electronic triggering means (not shown) and which should be as low as possible. With the maximum current intensity provided by the electronic triggering means, the resistance R of the magnetic winding 18 can be determined according to Ohm's law. The resistance R of the magnetic winding 18 can also be illustrated by the following formula:

$$R = \frac{\rho_L \cdot l_m \cdot W^2}{A \cdot K_L \cdot K_F}$$

The symbols used in this formula have the following meanings:

R = the ohmic resistance of the magnetic winding 18;
$\rho_L$ = the specific resistance of the winding wire;
$l_m = \pi \cdot a$, the average winding length with a as the average diameter of the magnetic winding 18;
W = the number of windings of the magnetic winding 18;
$K_L$ ($\leqq 1$) = the fill factor of the magnetic winding 18;
$K_F$ ($\leqq 1$) = the window fill factor; and
A = b·d, the window surface area of the shell core 7; b is the width and d the height of the window.

In this formula, the following values are predetermined as follows: The resistance R is predetermined, as noted above, by the maximum current intensity of the electronic triggering means, the resistance $\rho_L$ by the material of the magnetic winding 18 (for which copper or a copper alloy is preferably used) and the winding number W of the magnetic winding 18 by the magnetic induction B required in the outer air gap 85 between the outer core 15 and the flat armature 29 and in the inner air gap 86 between the inner core 17 and the flat armature 29. The fill factor $K_L$, which represents the packing density of the magnetic winding line, and the window fill factor $K_F$, which represents the extent to which the window surface area A is filled out by the magnetic winding 18, should be selected to be as large as possible; that is, they should be close to 1. Now in order to obtain a magnetic circuit 7, 18, 29 which is as small as possible and has the smallest possible armature mass, then in order to attain the required resistance R of the magnetic winding 18, the quotient $A/l_m$ should be selected to be as small as possible. The reductions made in accordance with the invention in the dimensions of the magnetic circuit 7, 18, 29 furthermore effect a reduction in scatter current, in eddy currents, and in losses associated with hysteresis, which reduce the force acting upon the flat armature 29 while it is attracting or dropping. The determination of A and $l_m$ after the value for $A/l_m$ has been fixed is accomplished in a known manner by means of optimizing b/d.

In accordance with the invention, it is also intended that the magnetic energy stored when the flat armature 29 is attracting be kept as small as possible, by means of the saturation of the magnetic circuit. This magnetic energy is built up during the attracting period of the flat armature 29, but it is not converted into a mechanical driving power. It is known that in an ideal and saturated magnetic circuit (without copper and iron losses), the most favorable case is that half the electrical energy consumed is converted into mechanical energy, while the other half is converted into useless magnetic energy, assuming that the magnetic circuit is fed with constant current. In contrast to this, in a magnetic circuit which is operated exclusively in a state of saturation, it is possible in the extreme case to convert 100% of the consumed electrical power into mechanical energy, because when the air gap is closed the magnetic field energy is reduced, while in an unsaturated magnet the field energy is increased. In accordance with the invention, the magnetic circuit 7, 18, 29 is embodied such that at the onset of the attracting movement of the flat armature 29, a magnetic induction B prevails in the vicinity of the air gaps 85, 86 between the flat armature 29 and the shell core 7 which is approximately 70% of the saturation induction. As a result of this provision, the energy stored in the attracting magnetic circuit is minimized to such an extent that the electrical power consumed during attraction is substantially converted into driving power. On the other sufficient force augmentation is still available to accelerate the flat armature during the attracting movement. Before the flat armature 29 drops from the shell core 7, there is thus a substantially smaller amount of magnetic energy to be destroyed, so that the dropping time can be reduced while the cancelling power of the electronic triggering means remains constant.

In accordance with the invention, the two air gaps 85, 86 are provided between the flat armature 29, which has the smallest possible mass, and the shell core 7. The air gaps 85, 86 act in the axial direction and their magnetically effective surface areas $A_1$ and $A_2$ are approximately identical in size. The doubling of the air gaps $A_1$ and $A_2$ acting in the axial direction results in the doubling of the attracting force, thus producing an electromagnet which operates very rapidly. Embodying the magnetically effective surface areas $A_1$ and $A_2$ in approximately identical size in the vicinity of the air gaps 85, 86, given the dimensions prescribed above, likewise assures that the air gaps will be magnetically saturated to such an extent that a slight unintended obliquity in the position of the flat armature will not be reinforced excessively by magnetic forces triggered thereby. As a result, complicated guidance means for the flat armature 29 are no longer required in order to prevent highly oblique positioning or unreplicatable movement on the part of the flat armature 29. The doubling of the attracting force which results from the two air gaps 85, 86 and the minimizing of the magnetic circuit 7, 18, 29 in accordance with the invention makes it possible to use expensive materials in the magnetic circuit. The highest magnetic flow appears in the crosspiece 16 of the shell core 7, while the magnetic flow in the vicinity of the two air gaps 85, 86 is substantially smaller, so that the cross sections of the outer core 15 and of the inner core 17 can be advantageously narrowed in the vicinity of the air gaps 85, 86. The narrowing of the cross sections of the magnetic circuit in the vicinity of the two air gaps 85, 86 may be effected, by way of example, by providing an inset 87 as shown at the end face of the inner core 17, or the outer circumference of the shell core 7 can taper conically in the axial direction toward the air gaps 85, 86 as shown in broken lines at 88 on the outer core 15.

The foregoing relates to preferred exemplary embodiments of the invention, it being understood that other embodiments and variants thereof are possible within the spirit and scope of the invention, the latter being defined by the appended claims.

The required resistance R of the magnetic winding 18 is attained by $0.8\ \text{mm} \leqq A/l_m \leqq 1.3\ \text{mm}$.

What is claimed and desired to be secured by Letters Patent of the United States is:

1. An electromagnet for controlling a fuel injection valve for internal combustion engines, having a magnetic circuit which includes:

a ferromagnetic shell core having a window surface area A;

an armature;

a magnetic winding, applied within the shell core, having an ohmic resistance R, a predetermined number of windings W, a fill factor $K_L$, and a window fill factor $K_F$, wherein the magnetic winding is comprised of a wire which as a specific resistance $S_L$ and a winding length $l_m$; and wherein the magnetic circuit is dimensioned according to the formula $$R = \frac{\rho_L \cdot l_m \cdot W^2}{A \cdot K_L \cdot K_F}$$

such that the quotient $A/l_m$ is selected to be as small as possible.

2. An electromagnet as defined by claim 1, having a saturation induction, characterized in that the magnetic circuit is embodied such that at the onset of the attracting movement of the armature, a magnetic induction B prevails in the vicinity of an air gap located between the armature and the shell core which is approximately 70% of the saturation induction.

3. An electromagnet as defined by claim 1, wherein the shell core has two end faces and wherein the armature is embodied as a flat armature between two axially acting air gaps which are provided between the two end faces of the shell core and the flat armature, and wherein the air gaps have magnetically effective surface areas which are approximately identical in size.

4. An electromagnet as defined by claim 2, wherein the shell core has two end faces and wherein the armature is embodied as a flat armature between two axially acting air gaps which are provided between the two end faces of the shell core and the flat armature, and wherein the air gaps have magnetically effective surface areas which are approximately identical in size.

5. An electromagnet as defined by claim 3, characterized in that cross sections of the magnetic circuit are narrowed in the vicinity of the two air gaps.

6. An electromagnet as defined by claim 4, characterized in that cross sections of the magnetic circuit are narrowed in the vicinity of the two air gaps.

* * * * *